US012013209B2

(12) United States Patent
Ernst et al.

(10) Patent No.: US 12,013,209 B2
(45) Date of Patent: Jun. 18, 2024

(54) BEAR SPRAY ALARM HOLSTER

(71) Applicants: Kevin William Ernst, Hamilton, MT (US); Jordan Carter, Missoula, MT (US)

(72) Inventors: Kevin William Ernst, Hamilton, MT (US); Jordan Carter, Missoula, MT (US)

( * ) Notice: Subject to any disclaimer, the term of this patent is extended or adjusted under 35 U.S.C. 154(b) by 135 days.

(21) Appl. No.: 17/944,799

(22) Filed: Sep. 14, 2022

(65) Prior Publication Data

US 2024/0085148 A1 Mar. 14, 2024

(51) Int. Cl.
*F41H 9/10* (2006.01)
*F41C 33/04* (2006.01)

(52) U.S. Cl.
CPC ..... *F41C 33/04* (2013.01); *F41H 9/10* (2013.01)

(58) Field of Classification Search
CPC ..... F41H 9/10; F41C 33/04; F41C 33/041; A45F 5/021; A45F 2200/0583; A45F 2200/0566; A45F 2200/0591; A45F 3/16
See application file for complete search history.

(56) References Cited

U.S. PATENT DOCUMENTS

| | | | | |
|---|---|---|---|---|
| 3,497,118 | A * | 2/1970 | Najjar | A63B 47/001 294/166 |
| 5,517,180 | A * | 5/1996 | Masi | F41H 9/10 340/691.7 |
| 10,624,442 | B2 * | 4/2020 | Evans | A45F 5/021 |
| 11,419,406 | B1 * | 8/2022 | Ricard | A45F 5/021 |
| 2006/0208019 | A1 * | 9/2006 | Rush | A45F 5/00 224/570 |
| 2007/0057004 | A1 * | 3/2007 | Butler | A45C 11/182 224/680 |
| 2009/0038664 | A1 * | 2/2009 | Juslin | A45B 3/00 135/66 |
| 2009/0152146 | A1 * | 6/2009 | Conklin | B25H 3/00 206/338 |

* cited by examiner

*Primary Examiner* — Adam J Waggenspack

(57) ABSTRACT

The bear spray holster with sound alarm is intended to prevent bear attacks on humans. The holster includes a cylindrical body for securing an aerosol canister and a portable alarm. In addition, the holster includes a pull strap that is configured to connect the canister to the detachable pull ring on the portable alarm. By securing both ends of the pull strap, the portable alarm activates when the canister is removed from the cylindrical body. During a bear encounter, the user can easily remove the canister from the holster and activate the portable alarm, all in one motion. Although bears typically hold their breath during a short-range charge or assault, the sound of the alarm disrupts the bear's breathing pattern. This disruption gives the user the best opportunity to spray in the direction of the bear, causing the bear to inhale more of the chemical repellant and retreat.

20 Claims, 11 Drawing Sheets

BEAR SPRAY ALARM HOLSTER

FIELD OF THE INVENTION

The present invention relates generally to a holster for bear spray. More specifically, the present invention is a holster that can carry a bear spray canister and a portable sound alarm. A specifically purposed designed pull strap connects the alarm to the canister, wherein the alarm activates when the canister is removed from the holster. This arrangement is most effective at preventing bear assaults.

BACKGROUND OF THE INVENTION

When camping or hiking out on a trail in bear country, a person should always be prepared for an encounter with a bear. The two most recognized effective bear deterrents are bear spray and loud noise makers. For convenience and safety, outdoor recreationists should have these items readily accessible. One example of a noise maker is an airhorn. The sound of an airhorn is disruptive and can cause the bear to move away. However, a noise maker such as an air horn is not as effective as bear spray in stopping a bear attack. At close range, the airhorn is less likely to deter the bear. Instead, bear sprays are most effective in a close-range assault. The proven chemical ingredients in a typical bear spray irritates the bear's eyes, nose, and lungs, which causes strong temporary discomfort. However, a bear typically holds its breath during a short charge or assault as it braces for impact; much like a person would do running up a short flight of stairs, or a football player carrying the ball through the front defensive line.

An object of the present invention is to combine the two most proven bear assault deterrents into one simultaneous functioning unit to be more effective at deterring bear attacks at close range. The present invention is a holster that carries a bear spray canister with an attached portable sound alarm. The portable alarm is configured to activate automatically when the bear spray is removed from the holster. Although the sound of the alarm alone may not stop the bear from charging at the person, it is sufficiently irritating and confusing to disrupt the bear's breathing posture during the assault charge. This allows the bear spray to work more effectively, causing the bear to inhale more of the chemical bear spray, deter the assault and move away. The combination of sound alarm and bear spray may also be effective in deterring the assault of a mountain lion, wolf, or other wild animals on people recreating in the out of doors. This will help mitigate conflict between animals and people.

SUMMARY

It is an aim of the present invention to mitigate bear assaults on people. The present invention comprises a cylindrical body for securing an aerosol canister of bear spray in an easy quick-draw design with a portable sound alarm. The present invention further comprises a specifically designed pull strap that is configured to connect the canister to a detachable pull ring on the portable alarm. By securing both ends of the pull strap, the portable alarm activates when the bear spray canister is removed from the cylindrical body. During a bear encounter, the user can easily and quickly remove the canister from the holster and activate the portable alarm, all in one motion. Although bears typically hold their breath during a close-range assault charge, the sound of the alarm disrupts the bear's breathing pattern. This disruption gives the user the best opportunity to spray in the direction of the bear and allow the bear to inhale an increased amount of the chemical repellant causing a retreat from the assault.

DETAIL DESCRIPTIONS OF THE INVENTION

All illustrations of the drawings are for the purpose of describing selected versions of the present invention and are not intended to limit the scope of the present invention.

Figure 1:
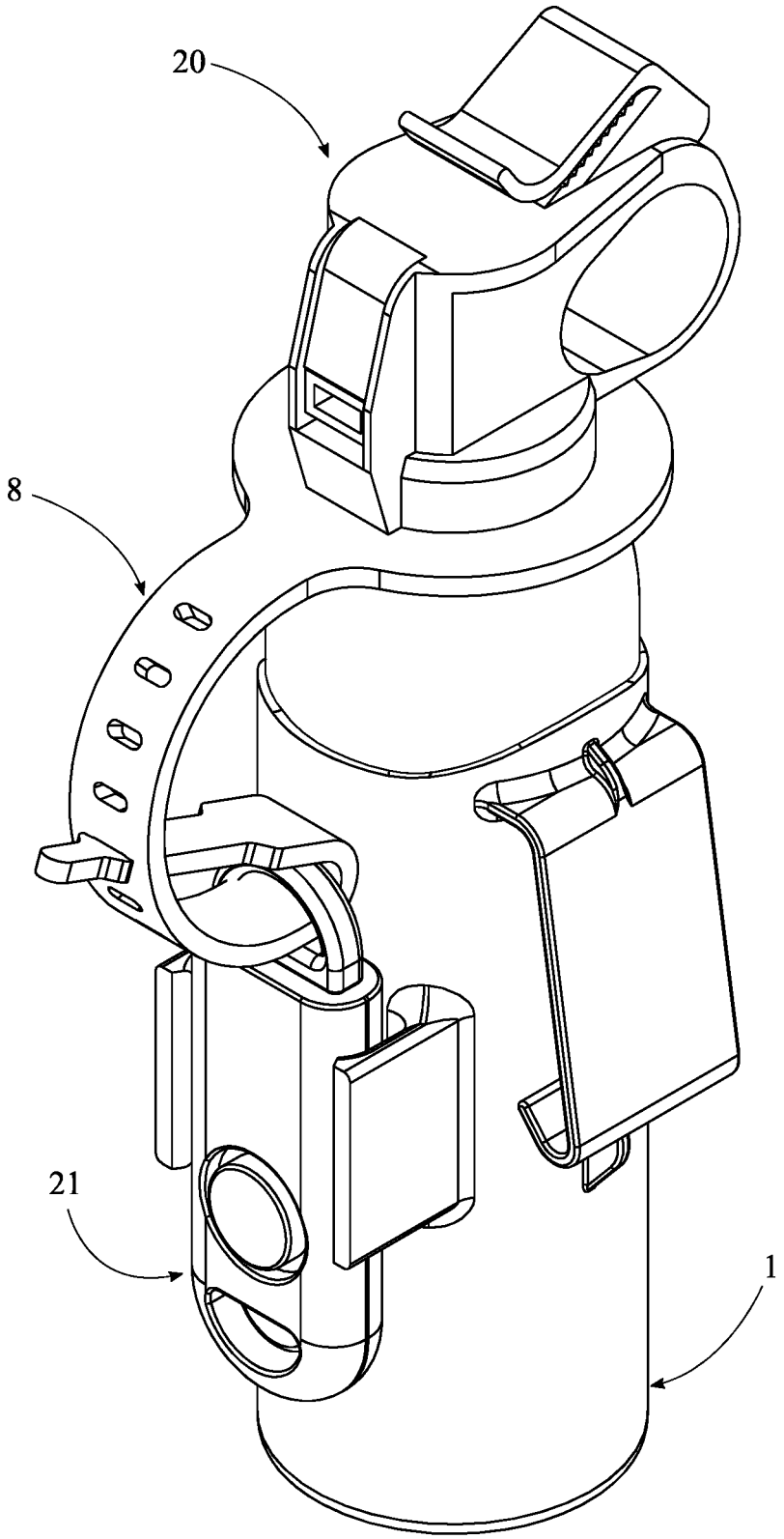
FIG. 1 is a top-rear perspective view of the present invention.
Figure 2:
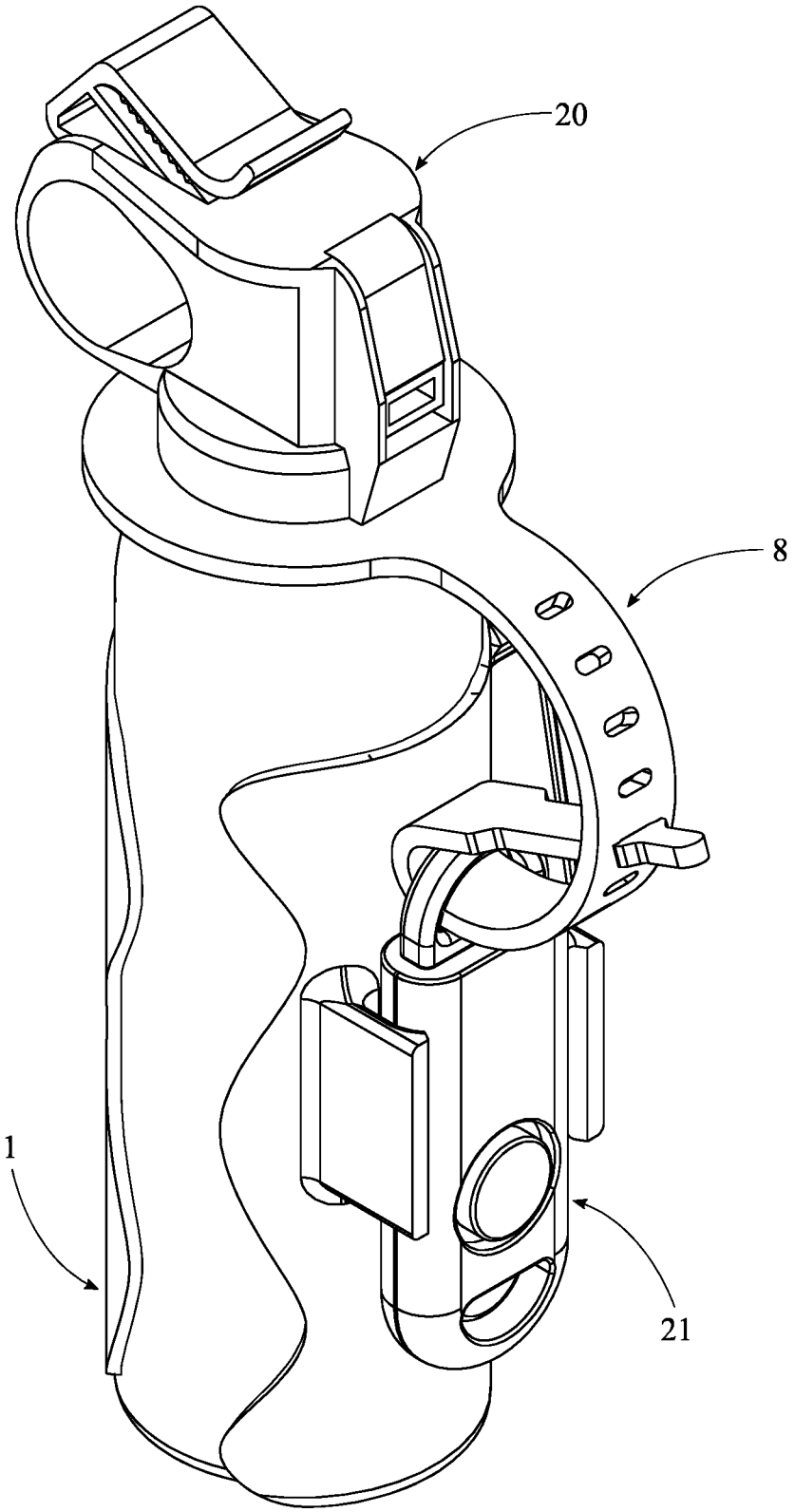
FIG. 2 is a top-front perspective view of the present invention.

In reference to FIG. 1 and FIG. 2, the present invention is a bear spray holster with sound alarm. It is an aim of the present invention to prevent bear attacks on humans. The present invention comprises a cylindrical body 1 for securing an aerosol canister 20 and a portable alarm 21. The aerosol canister 20 can be of any type having a cylindrical shape. The portable alarm 21 can be of any type having a detachable pull ring on one end, and an anchor loop on the opposite end. The anchor loop is typically used to attach the portable alarm 21 to a fixed structure, and the alarm activates when the pull ring is removed. The present invention further comprises a pull strap 8 that is configured to connect the canister 20 to the detachable pull ring on the portable alarm 21. Specifically, one end of the pull strap 8 fits around the neck of the canister 20. The other end of the pull strap 8 is first inserted through the detachable pull ring of the portable alarm 21, and then inserted into one of the plurality of slots located on the pull strap 8, thereby creating a closed loop around the detachable pull ring. By securing both ends of the pull strap 8, the portable alarm 21 activates when the canister 20 is removed from the cylindrical body 1. During a bear encounter, the user can easily remove the canister 20 from the holster and activate the portable alarm 21, all in one motion. Although bears typically hold their breath just before they attack, the sound of the alarm disrupts the bear's breathing. This disruption gives the user the best opportunity to spray in the direction of the bear, causing the bear to inhale the chemical repellant and retreat.

Figure 3:
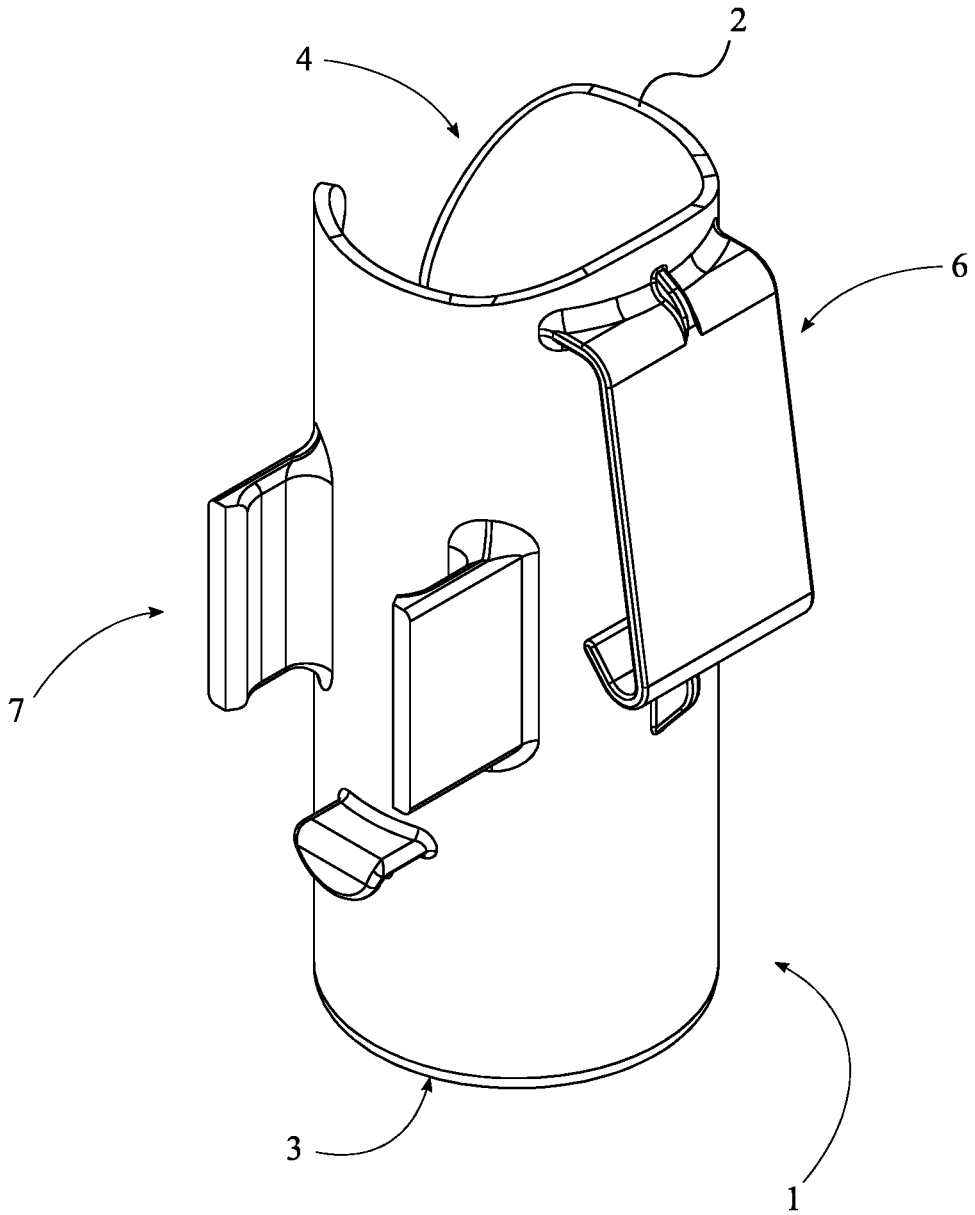
FIG. 3 is a top-rear perspective view of the cylindrical body of the present invention.
Figure 4:
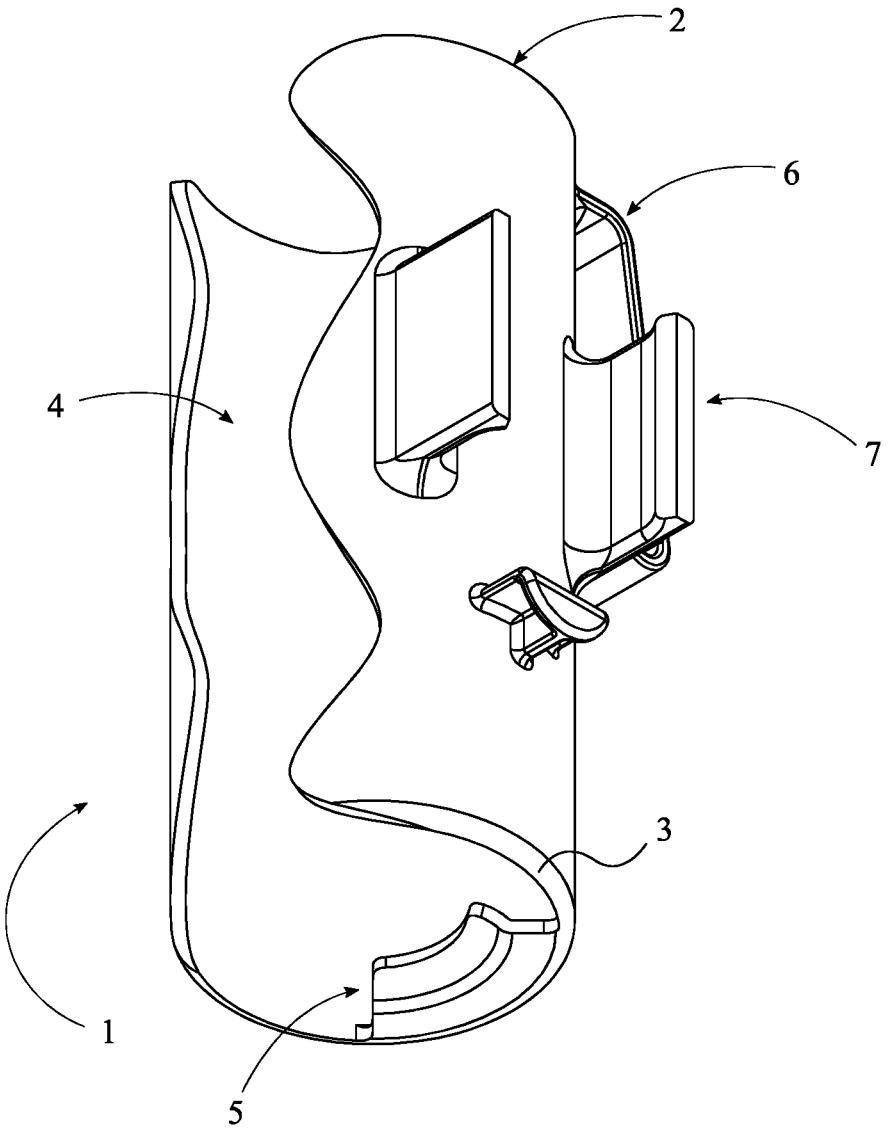
FIG. 4 is a bottom-front perspective view of the cylindrical body of the present invention.

The cylindrical body 1 further comprises a top 2, a bottom 3, an expandable opening 4, an inward-facing flange 5, an outward-facing clip 6, and an alarm holder 7. As best seen in FIG. 3 and FIG. 4, the cylindrical body 1 functions as the primary structural body of the present invention, as the remaining components of the present invention are configured upon the cylindrical body 1. More specifically, the expandable opening 4 secures the canister 20 to the cylindrical body 1. The inward-facing flange 5 engages with the bottom of the canister 20, preventing the canister 20 from sliding down below the bottom 3. The outward-facing clip 6 attaches the cylindrical body 1 to the user's waistband or backpack, giving the user quick access to the canister 20. The portable alarm 21 removably attaches to the alarm holder 7, permitting dual functionality of the portable alarm 21. Specifically, the portable alarm 21 can be used with the present invention (as will be discussed in greater detail below), or function independently and placed at a campsite where it is triggered by motion detection.

Figure 8:
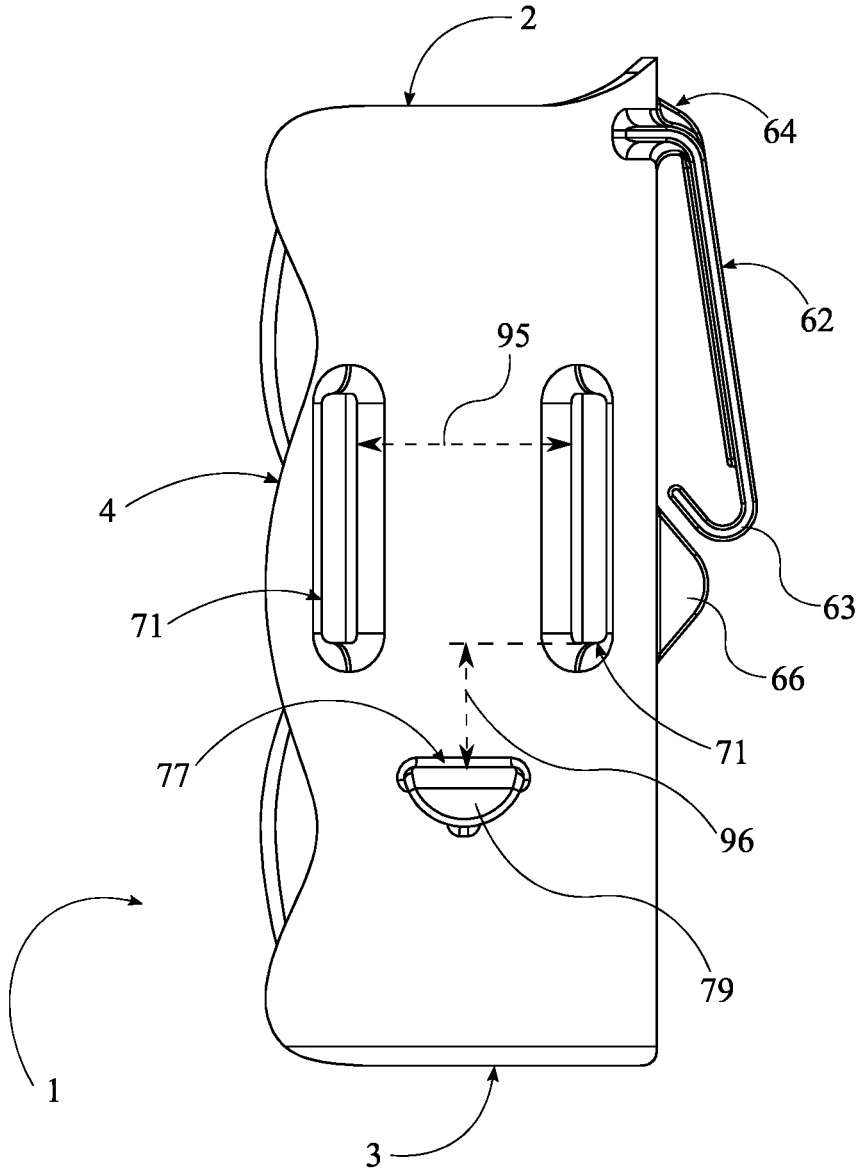
FIG. 8 is a right-side elevational view of the cylindrical body of the present invention.
Figure 9:
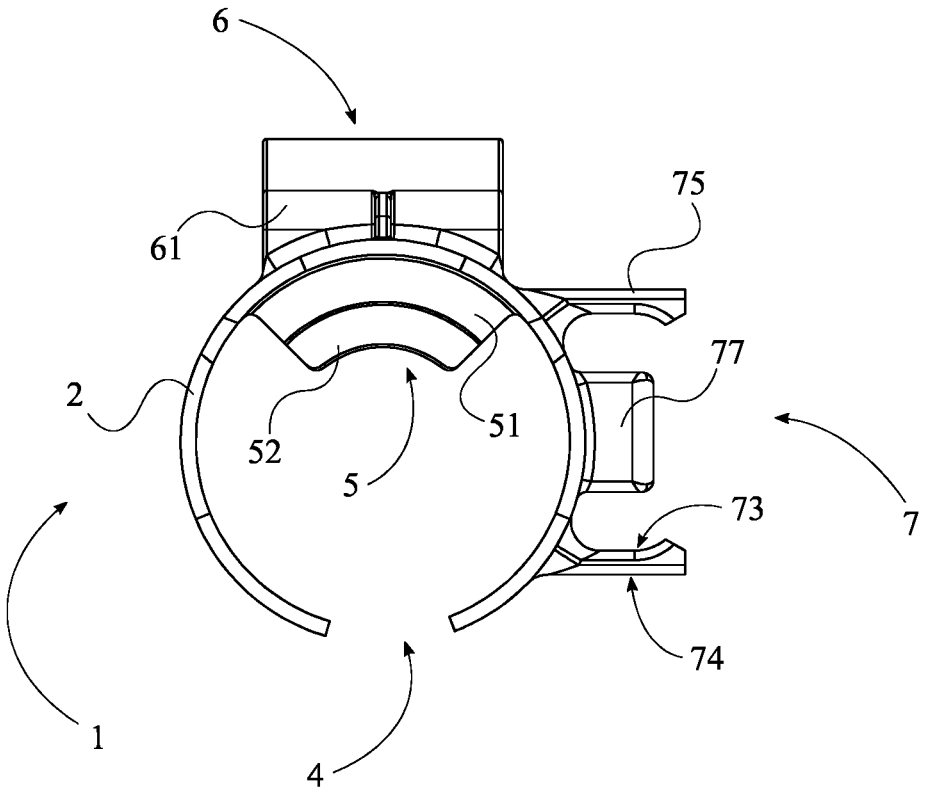
FIG. 9 is a is a top plan view of the cylindrical body of the present invention.
Figure 11:
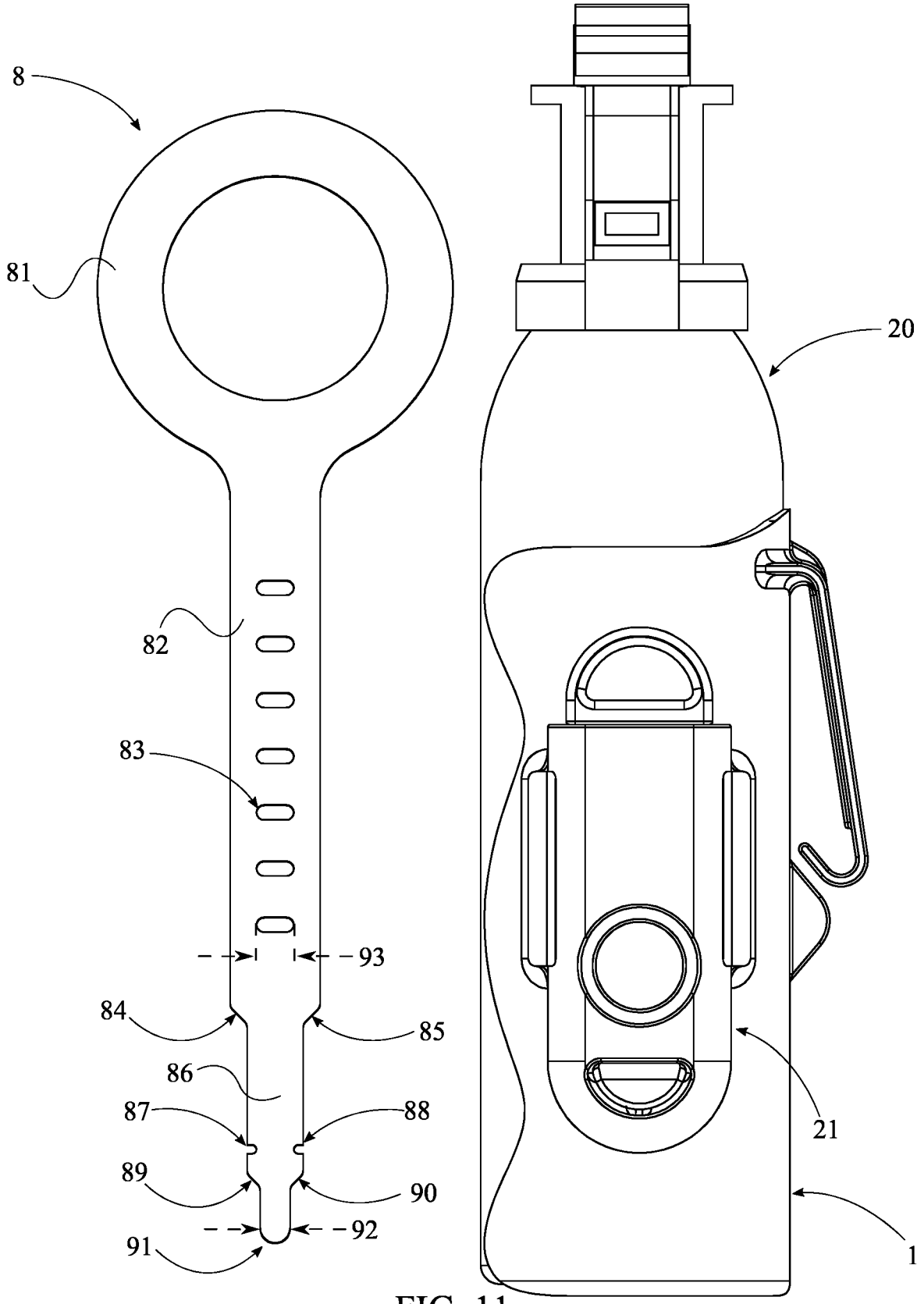
FIG. 11 is a right-side elevational view of the present invention, showing the pull strap unattached.

As best seen in FIG. 9, the top 2 is circular in shape and fully open to receive the canister 20. The expandable opening 4 traverses longitudinally from the top 2 to the bottom 3. This allows the cylindrical body 1 to expand radially outward into a larger diameter for proper grip of the canister 20. The inward-facing flange 5 is terminally connected to the bottom 3, opposite and perpendicular to the expandable opening 4. The inward-facing flange 5 forms a platform on which a portion of the bottom of the canister can rest upon. The outward-facing clip 6 is positioned opposite of the inward-facing flange 5. The wide, elastic clamp of the outward-facing clip 6 allows the cylindrical body 1 to attach to many different surfaces including the user's waistband or backpack. The alarm holder 7 is positioned orthogonal to the outward-facing clip 6, facing forward of the user when the outward-facing clip 6 is attached to the user's right hip. As best seen in FIG. 8, the alarm holder 7 further comprises a pair of jaws 71, a male adaptor 72, and a spacing 96. The pair of jaws 71 are vertically oriented and opposingly aligned to face each other. The male adaptor 72 is positioned below and centered between the pair of jaws 71. The spacing 96 between the pair of jaws 71 and the male adaptor 72 is delineated by the positioning of the anchor loop on the portable alarm 21. As best seen in FIG. 11, when the portable alarm 21 is inserted into the alarm holder 7, the pair of jaws 71 clamp and hold the sides of the portable alarm 21, thereby restricting lateral movement. The male adaptor 72 fits into the anchor loop on the portable alarm 21. This arrangement prevents the portable alarm 21 from sliding out of the pair of jaws 71.

Figure 5:
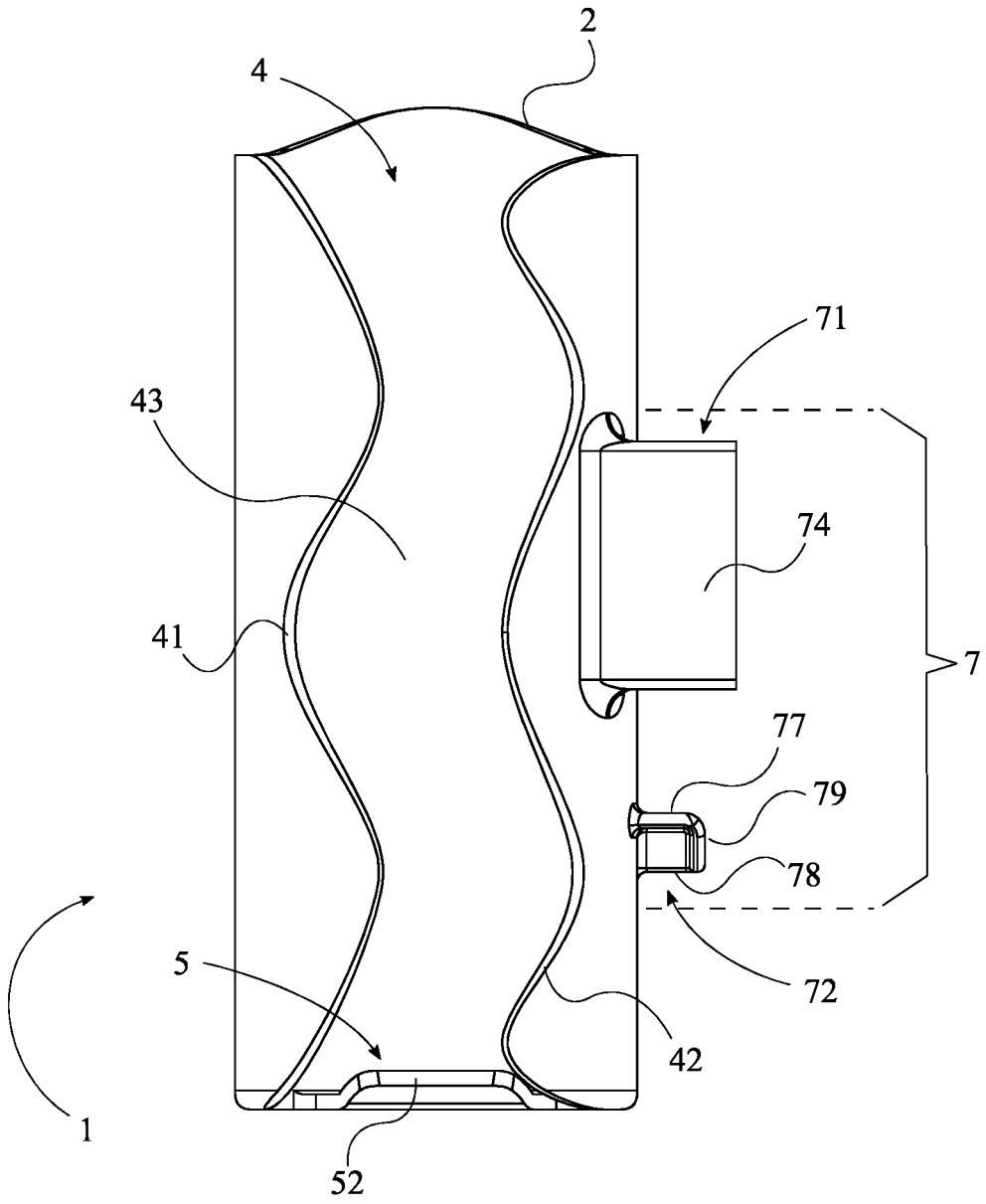
FIG. 5 is a front elevational view of the cylindrical body of the present invention.

In order to properly secure the canister 20 to the cylindrical body 1, the expandable opening 4 comprises a left side 41, a right side 42, and a gap 43. As best seen in FIG. 5, the left side 41 and the right side 42 are both parallel and offset from each other, delineated by the gap 43. The left side 41 spans from the top 2 to the bottom 3. The left side 41 is flared at the top 2 and flared at the bottom 3. The right side 42 spans from the top 2 to the bottom 3. The right side 42 is flared at the top 2 and flared at the bottom 3. The gap 43 is positioned between the left side 41 and the right side 42. Moreover, the gap 43 is wave-shaped in the longitudinal direction. The combination of both the flared ends and the wave shape helps the user quickly retrieve the canister 20 in an emergency (e.g., bear encounter).

Figure 10:
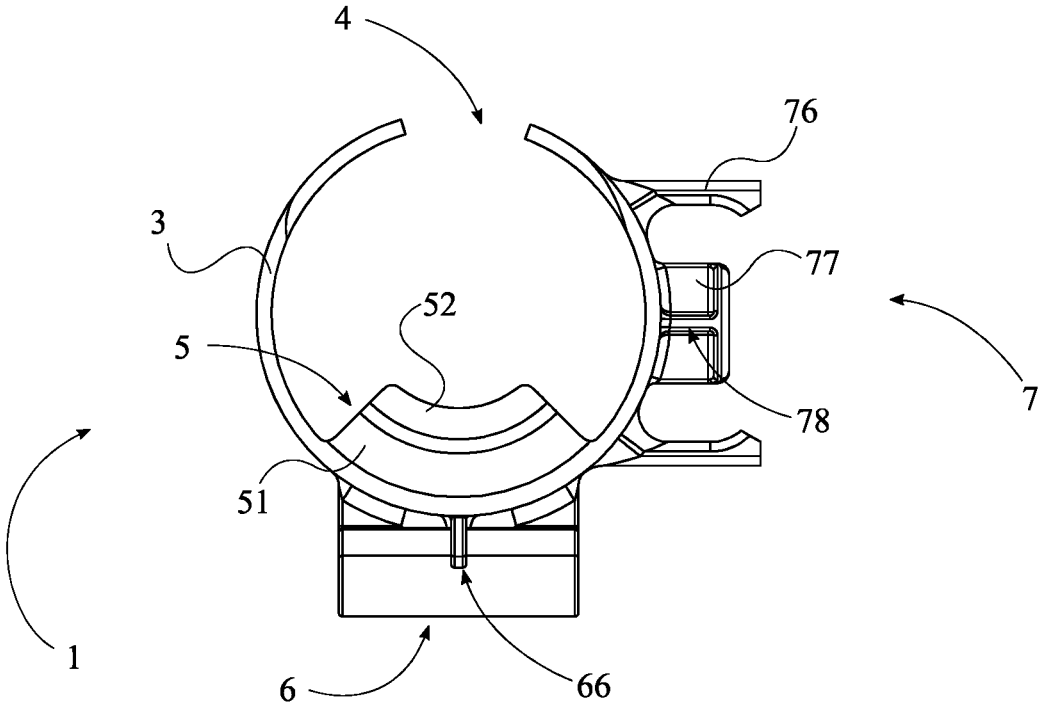
FIG. 10 is a bottom plan view of the cylindrical body of the present invention.

Canisters are typically formed with a concavity at the bottom, which is encircled by an annular bottom bead. In order to properly secure the bottom of the canister 20 to the cylindrical body 1, the inward-facing flange 5 comprises a bottom tab 51 and an upper lip 52. As seen in FIG. 5 and FIGS. 9-10, the bottom tab 51 is terminally connected to the bottom 3 of the cylindrical body 1 and extends radially inward. The upper lip 52 is terminally connected to the bottom tab 51 and extends upward and radially inward at an obtuse angle with the bottom tab 51. When the canister 20 is inserted into the cylindrical body 1, both the bottom tab 51 and the upper lip 52 engage the contoured area of the bottom of the canister 20.

Figure 6:
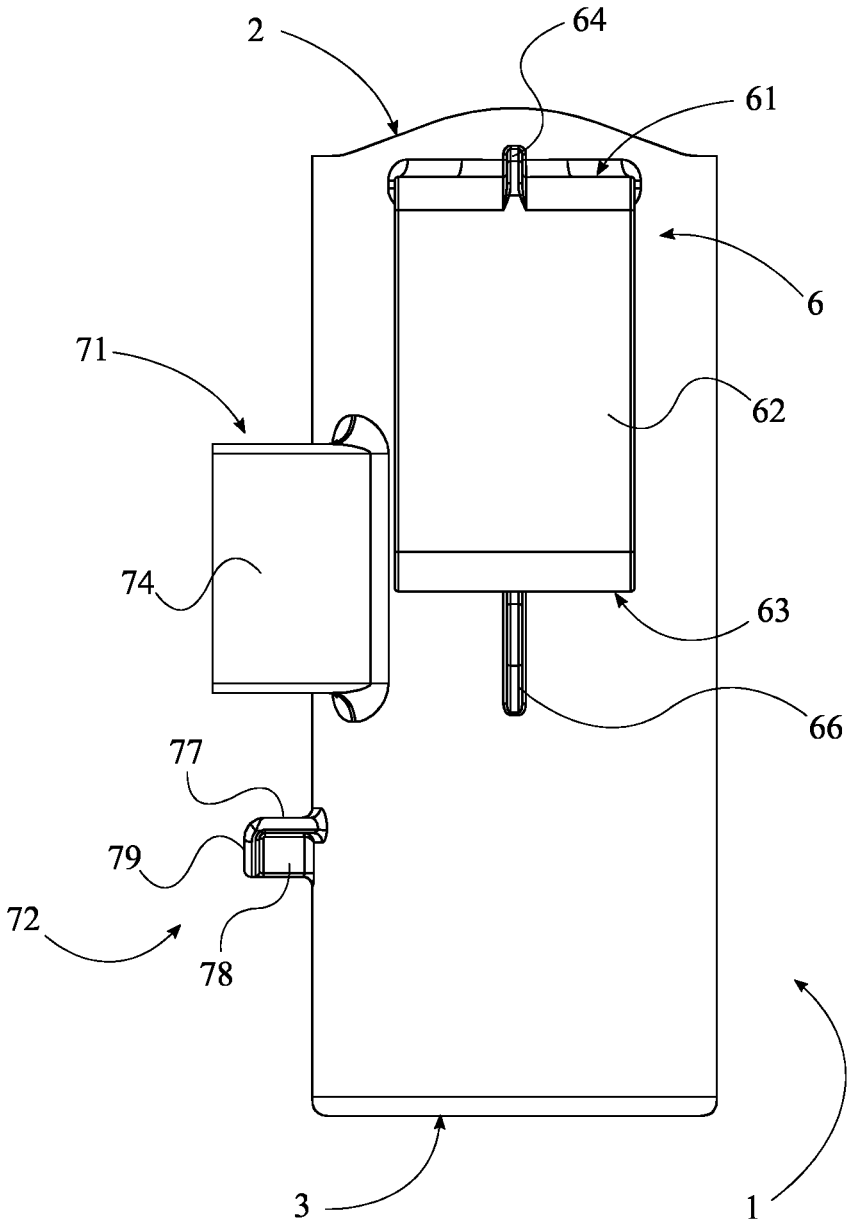
FIG. 6 is a rear elevational view of the cylindrical body of the present invention.
Figure 7:
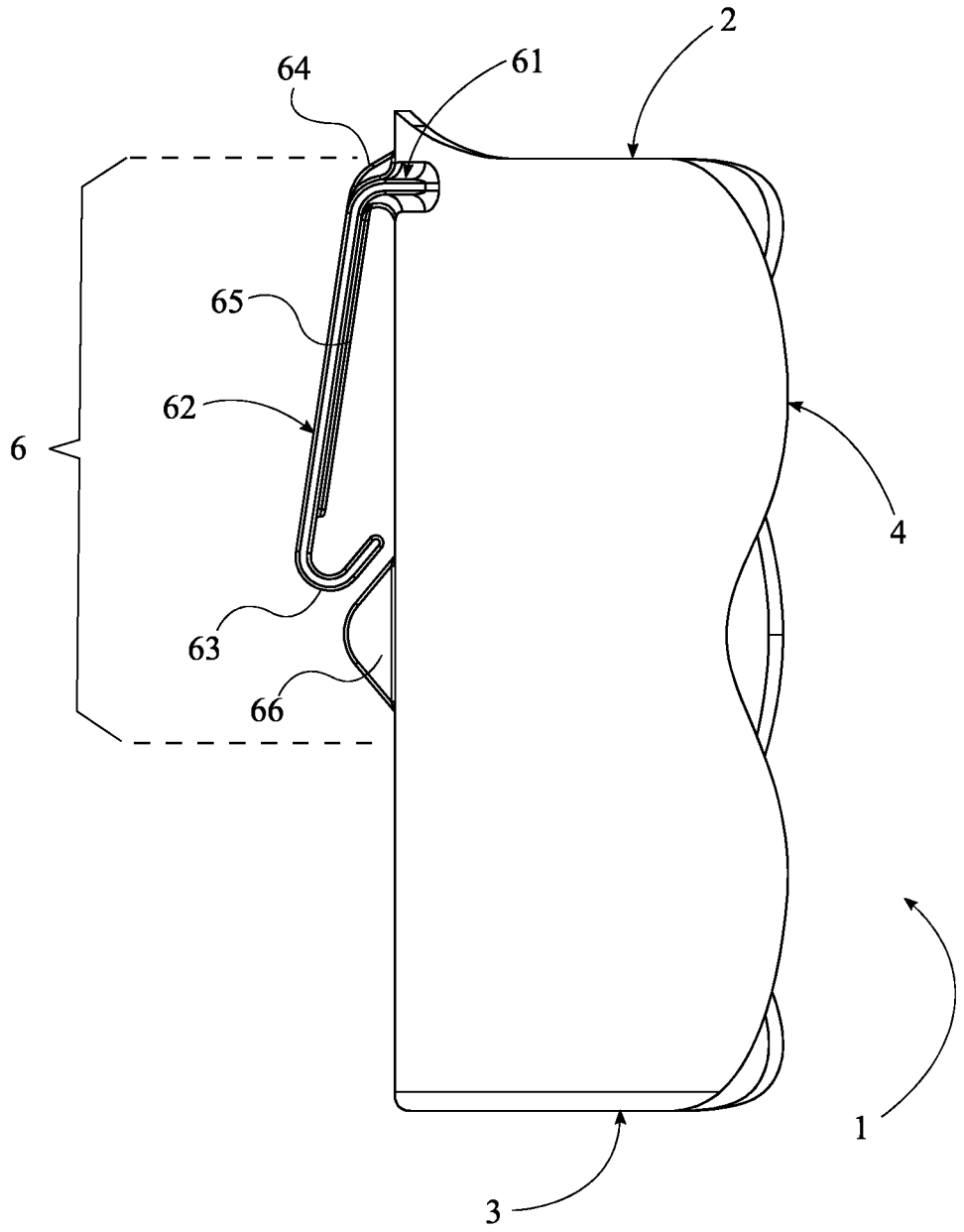
FIG. 7 is a left-side elevational view of the cylindrical body of the present invention.

In order to effectively secure the cylindrical body 1 to the user's waistband or backpack, the outward-facing clip 6 comprises an offset tab 61, a clamping member 62, a hook 63, an external brace 64, an internal brace 65, and a retention tab 66. As best seen in FIGS. 6-7, the offset tab 61 is horizontally oriented and extends outward from the cylindrical body 1. The purpose of the offset tab 61 is to provide sufficient space for clamping thick materials, such as a backpack handle. The clamping member 62 is terminally connected to the offset tab 61 and extends down and outward at an acute angle with the cylindrical body 1. The hook 63 is terminally connected to the clamping member 62 and extends up and inward at an acute angle with the clamping member 62. This arrangement allows the outward-facing clip 6 to easily latch onto many different surfaces. Once latched, the hook 63 secures the clamped material in place. As a means for increasing structural rigidity, the external brace 64 is centrally disposed along the top surface of the offset tab 61, and is adjacently connected to the cylindrical body 1 and the clamping member 62. The internal brace 65 is centrally disposed along the inner surface of the clamping member 62. As a further security measure, the retention tab 66 is positioned below the clamped portion. Specifically, the retention tab 66 is a V-shaped plate that is vertically oriented and extends outward from the cylindrical body 1. The retention tab 66 is centered below the hook 63. This arrangement allows the retention tab 66 to press up against the clamped material, thereby restricting the movement of the clamped material while the user is jogging.

In order to effectively clamp and hold the portable alarm 21 to the alarm holder 7, each of the jaws 71 comprises an interior side 73, an exterior side 74, a top surface 75, a bottom surface 76, and a width 95. As best seen in FIGS. 8-9, each of the pair of jaws 71 extend outward from the cylindrical body 1. The interior sides 73 of both jaws 71 face each other and the exterior sides 74 of both jaws 71 face opposite of each other. The interior side 73 of each of the jaws 71 contains a groove in the shape of a U or an arc that traverses longitudinally from the top surface 75 to the bottom surface 76. The width 95 between the interior sides 73 of the pair of jaws is delineated by the width of the portable alarm 21. As best seen in FIG. 11, when the portable alarm 21 is attached, the pair of jaws 71 elastically expand and grip the sides of the portable alarm 21.

In order to effectively prevent the portable alarm 21 from sliding out from the pair of jaws 71, the male adaptor 72 comprises a top plate 77, a rib 78, and a front plate 79. As best seen in FIG. 5 and FIG. 10, both the top plate 77 and the rib 78 extend outward from the cylindrical body 1. Both the top plate 77 and the rib 78 are adjacently connected to each other in the shape of a T. More specifically, the top plate 77 is horizontally oriented and the rib 78 is centered below and perpendicular to the top plate 77. The front plate 79 is terminally connected to the top plate 77 and the rib 78. Moreover, the front plate 79 extends from the top edge of the top plate 77, down to the bottom edge of the rib 78, forming a semi-circle shape. This arrangement allows the portable alarm 21 to slidably engage with the male adaptor 72, as seen in FIG. 11. It is to be understood that the front plate 79 is not limited to the shape of a semi-circle, and can take the form of any other shape suitable to fit the opening of the anchor loop on the portable alarm 21.

In order to effectively connect the canister 20 to the detachable pull ring of the portable alarm 21, the pull strap 8 comprises a collar 81, a main body 82, a plurality of slots 83, a pair of angular edges 84 and 85, a narrow body 86, a pair of opposingly aligned transverse notches 87 and 88, a pair of marginal edges 89 and 90, a bulbous tip 91, a first width 92, and a second width 93. In reference to FIG. 11, the opening of the collar 81 is sized to match the neck of the canister 20, so that when the collar 81 is slid over the top of the canister 20, the collar 81 fits snug between the trigger handle and neck of the canister 20. The main body 82 is terminally connected to the collar 81. The main body 82 is constructed of a desired width to accommodate the opening of the pull ring on the portable alarm 21, as well as a desired length to accommodate the height of the canister 20. The plurality of longitudinally aligned slots 83 are equally distanced from one another and disposed along the main body 82. The plurality of slots 83 is a self-locking, adjustable feature that enables the user to insert the bulbous tip 91 into any of the plurality of slots 83. Further along the end of the pull strap 8, the angular edges 84 and 85 traverse longitudinally and inward, connecting the main body 82 to the narrow body 86. This arrangement reduces the width of the pull strap 8. The pair of opposingly aligned transverse notches 87 and 88 are disposed along the narrow body 86. The width between the transverse notches 87 and 88 at its narrowest point is equal to the width of each of the plurality of slots 83, thereby enabling the transverse notches 87 and 88 to slidably engage and lock in place within any of the plurality of slots 83. The marginal edges 89 and 90 traverse longitudinally and inward, further narrowing the pull strap 8 and connecting the narrow body 86 to the bulbous tip 91. The first width 92 of the bulbous tip 91 is narrower than the second width 93 of each of the plurality of slots 83. This allows the user to insert the bulbous tip 91 through one of the slots 83. The bulbous tip 91 is further pulled through until the transverse notches 87 and 88 slidably engage and lock in place within the slot 83.

Although the invention has been explained in relation to its preferred embodiment, it is to be understood that many other possible modifications and variations can be made without departing from the spirit and scope of the invention as hereinafter claimed.

What is claimed is:

1. A holster comprising:
a cylindrical body;
a pull strap;
the cylindrical body comprising a top, a bottom, an expandable opening, an inward-facing flange, an outward-facing clip, and an alarm holder;
the top being fully open and circular in shape;
the expandable opening traversing longitudinally from the top to the bottom;
the inward-facing flange being terminally connected to the bottom;
the inward-facing flange positioned opposite and perpendicular to the expandable opening;
the outward-facing clip positioned opposite of the inward-facing flange;
the alarm holder positioned 90° clockwise from the outward-facing clip;
the alarm holder comprising a pair of jaws, a male adaptor, and a spacing;
the pair of jaws being positioned to face each other;
the male adaptor being positioned below and centered between the pair of jaws; and
the spacing between the pair of jaws and the male adaptor being delineated by a predefined length.

2. The holster as claimed in claim 1 comprising:
the expandable opening comprising a left side, a right side, and a gap;
the left side spanning from the top to the bottom;
the left side being flared at the top and flared at the bottom;
the right side spanning from the top to the bottom;
the right side being flared at the top and flared at the bottom; and
the left side and the right side being parallel and offset from each other, delineated by the gap.

3. The holster as claimed in claim 2 comprising:
the gap being wave-shaped, traversing in the longitudinal direction.

4. The holster as claimed in claim 1 comprising:
the inward-facing flange comprising a bottom tab and an upper lip;
the bottom tab being terminally connected to the bottom of the cylindrical body;
the bottom tab extending radially inward;
the upper lip being terminally connected to the bottom tab; and
the upper lip extending upward and radially inward at an obtuse angle with the bottom tab.

5. The holster as claimed in claim 1 comprising:
the outward-facing clip comprising an offset tab, a clamping member, a hook, an external brace, an internal brace, and a retention tab;
the offset tab being terminally connected to the cylindrical body;
the offset tab extending outward;
the clamping member being terminally connected to the offset tab;
the clamping member extending down and outward at an acute angle with the cylindrical body;
the hook being terminally connected to the clamping member;
the hook extending up and inward at an acute angle with the clamping member;
the external brace being centrally disposed on top of the offset tab;
the external brace being adjacently connected to the cylindrical body and the clamping member;
the internal brace being centrally disposed on inner surface of the clamping member;
the retention tab being V-shaped;
the retention tab extending outward from the cylindrical body; and
the retention tab being positioned below and centered with the hook.

6. The holster as claimed in claim 1 comprising:
each of the pair of jaws extending outward from the cylindrical body;
each of the pair of jaws comprising an interior side, an exterior side, a top surface, a bottom surface, and a width;
the interior side of each of the pair of jaws being positioned to face each other;
the exterior side of each of the pair of jaws being positioned to face opposite of each other; and
the width between the interior side of each of the pair of jaws being delineated by a predefined length.

7. The holster as claimed in claim 6 comprising:
the interior side of each of the pair of jaws containing a U-shaped groove traversing longitudinally from the top surface to the bottom surface.

8. The holster as claimed in claim 1 comprising:
the male adaptor comprising a top plate, a rib, and a front plate;
the top plate being horizontally oriented, extending outward from the cylindrical body;
the rib being positioned perpendicular to the top plate;
the rib extending outward from the cylindrical body;
the rib being adjacently connected to the top plate;
the rib being positioned below and center with the top plate;
the front plate being terminally connected to the top plate and the rib; and
the front plate being shaped as a semi-circle.

9. The holster as claimed in claim 1 comprising:
the pull strap comprising a collar, a main body, a plurality of slots, a pair of angular edges, a narrow body, a pair of notches, a pair of marginal edges, a bulbous tip, a first width, and a second width;
the collar being delineated by a predefined length;
the main body being terminally connected to the collar;
the plurality of slots being disposed along the main body;
the plurality of slots being longitudinally aligned and equally distanced from one another;
the pair of angular edges traversing longitudinally and inward, connecting the main body to the narrow body;
the pair of notches being disposed along the narrow body;
the pair of notches being opposingly aligned and transverse;
the pair of marginal edges traversing longitudinally and inward, connecting the narrow body to the bulbous tip; and
the first width of the bulbous tip being narrower than the second width of each of the plurality of slots.

10. A holster comprising:
a cylindrical body;
a pull strap;
the cylindrical body comprising a top, a bottom, an expandable opening, an inward-facing flange, an outward-facing clip, and an alarm holder;
the top being fully open and circular in shape;
the expandable opening traversing longitudinally from the top to the bottom;
the expandable opening comprising a left side, a right side, and a gap;
the left side spanning from the top to the bottom;
the left side being flared at the top and flared at the bottom;
the right side spanning from the top to the bottom;
the right side being flared at the top and flared at the bottom;
the left side and the right side being parallel and offset from each other, delineated by the gap;
the gap being wave-shaped, traversing in the longitudinal direction;
the inward-facing flange being terminally connected to the bottom;
the inward-facing flange positioned opposite and perpendicular to the expandable opening;
the outward-facing clip positioned opposite of the inward-facing flange;
the alarm holder positioned 90° clockwise from the outward-facing clip;
the alarm holder comprising a pair of jaws, a male adaptor, and a spacing;
the pair of jaws being positioned to face each other;
the male adaptor being positioned below and centered between the pair of jaws; and
the spacing between the pair of jaws and the male adaptor being delineated by a predefined length.

11. The holster as claimed in claim 10 comprising:
the inward-facing flange comprising a bottom tab and an upper lip;
the bottom tab being terminally connected to the bottom of the cylindrical body;
the bottom tab extending radially inward;
the upper lip being terminally connected to the bottom tab; and
the upper lip extending upward and radially inward at an obtuse angle with the bottom tab.

12. The holster as claimed in claim 10 comprising:
the outward-facing clip comprising an offset tab, a clamping member, a hook, an external brace, an internal brace, and a retention tab;
the offset tab being terminally connected to the cylindrical body;
the offset tab extending outward;
the clamping member being terminally connected to the offset tab;
the clamping member extending down and outward at an acute angle with the cylindrical body;
the hook being terminally connected to the clamping member;
the hook extending up and inward at an acute angle with the clamping member;
the external brace being centrally disposed on top of the offset tab;
the external brace being adjacently connected to the cylindrical body and the clamping member;
the internal brace being centrally disposed on inner surface of the clamping member;
the retention tab being V-shaped;
the retention tab extending outward from the cylindrical body; and
the retention tab being positioned below and centered with the hook.

13. The holster as claimed in claim 10 comprising:
each of the pair of jaws extending outward from the cylindrical body;
each of the pair of jaws comprising an interior side, an exterior side, a top surface, a bottom surface, and a width;
the interior side of each of the pair of jaws being positioned to face each other;
the exterior side of each of the pair of jaws being positioned to face opposite of each other; and
the width between the interior side of each of the pair of jaws being delineated by a predefined length.

14. The holster as claimed in claim 13 comprising:
the interior side of each of the pair of jaws containing a U-shaped groove traversing longitudinally from the top surface to the bottom surface.

15. The holster as claimed in claim 10 comprising:
the male adaptor comprising a top plate, a rib, and a front plate;
the top plate being horizontally oriented, extending outward from the cylindrical body;
the rib being positioned perpendicular to the top plate;
the rib extending outward from the cylindrical body;
the rib being adjacently connected to the top plate;

the rib being positioned below and center with the top plate;

the front plate being terminally connected to the top plate and the rib; and the front plate being shaped as a semi-circle.

16. The holster as claimed in claim 10 comprising:

the pull strap comprising a collar, a main body, a plurality of slots, a pair of angular edges, a narrow body, a pair of notches, a pair of marginal edges, a bulbous tip, a first width, and a second width;

the collar being delineated by a predefined length;

the main body being terminally connected to the collar;

the plurality of slots being disposed along the main body;

the plurality of slots being longitudinally aligned and equally distanced from one another;

the pair of angular edges traversing longitudinally and inward, connecting the main body to the narrow body;

the pair of notches being disposed along the narrow body;

the pair of notches being opposingly aligned and transverse;

the pair of marginal edges traversing longitudinally and inward, connecting the narrow body to the bulbous tip; and the first width of the bulbous tip being narrower than the second width of each of the plurality of slots.

17. A holster comprising:

a cylindrical body;

a pull strap;

the cylindrical body comprising a top, a bottom, an expandable opening, an inward-facing flange, an outward-facing clip, and an alarm holder;

the top being fully open and circular in shape;

the expandable opening traversing longitudinally from the top to the bottom;

the expandable opening comprising a left side, a right side, and a gap;

the left side spanning from the top to the bottom;

the left side being flared at the top and flared at the bottom;

the right side spanning from the top to the bottom;

the right side being flared at the top and flared at the bottom;

the left side and the right side being parallel and offset from each other, delineated by the gap;

the gap being wave-shaped, traversing in the longitudinal direction;

the inward-facing flange being terminally connected to the bottom;

the inward-facing flange positioned opposite and perpendicular to the expandable opening;

the inward-facing flange comprising a bottom tab and an upper lip;

the bottom tab being terminally connected to the bottom of the cylindrical body;

the bottom tab extending radially inward;

the upper lip being terminally connected to the bottom tab;

the upper lip extending upward and radially inward at an obtuse angle with the bottom tab;

the outward-facing clip positioned opposite of the inward-facing flange;

the alarm holder positioned 90° clockwise from the outward-facing clip;

the alarm holder comprising a pair of jaws, a male adaptor, and a spacing;

the pair of jaws being positioned to face each other;

each of the pair of jaws extending outward from the cylindrical body;

each of the pair of jaws comprising an interior side, an exterior side, a top surface, a bottom surface, and a width;

the interior side of each of the pair of jaws being positioned to face each other;

the exterior side of each of the pair of jaws being positioned to face opposite of each other;

the width between the interior side of each of the pair of jaws being delineated by a predefined length;

the interior side of each of the pair of jaws containing a U-shaped groove traversing longitudinally from the top surface to the bottom surface;

the male adaptor being positioned below and centered between the pair of jaws; and the spacing between the pair of jaws and the male adaptor being delineated by a predefined length.

18. The holster as claimed in claim 17 comprising:

the outward-facing clip comprising an offset tab, a clamping member, a hook, an external brace, an internal brace, and a retention tab;

the offset tab being terminally connected to the cylindrical body;

the offset tab extending outward;

the clamping member being terminally connected to the offset tab;

the clamping member extending down and outward at an acute angle with the cylindrical body;

the hook being terminally connected to the clamping member;

the hook extending up and inward at an acute angle with the clamping member;

the external brace being centrally disposed on top of the offset tab;

the external brace being adjacently connected to the cylindrical body and the clamping member;

the internal brace being centrally disposed on inner surface of the clamping member;

the retention tab being V-shaped;

the retention tab extending outward from the cylindrical body; and the retention tab being positioned below and centered with the hook.

19. The holster as claimed in claim 17 comprising:

the male adaptor comprising a top plate, a rib, and a front plate;

the top plate being horizontally oriented, extending outward from the cylindrical body;

the rib being positioned perpendicular to the top plate;

the rib extending outward from the cylindrical body;

the rib being adjacently connected to the top plate;

the rib being positioned below and center with the top plate;

the front plate being terminally connected to the top plate and the rib; and the front plate being shaped as a semi-circle.

20. The holster as claimed in claim 17 comprising:

the pull strap comprising a collar, a main body, a plurality of slots, a pair of angular edges, a narrow body, a pair of notches, a pair of marginal edges, a bulbous tip, a first width, and a second width;

the collar being delineated by a predefined length;

the main body being terminally connected to the collar;

the plurality of slots being disposed along the main body;

the plurality of slots being longitudinally aligned and equally distanced from one another;

the pair of angular edges traversing longitudinally and inward, connecting the main body to the narrow body;

the pair of notches being disposed along the narrow body;

the pair of notches being opposingly aligned and transverse;

the pair of marginal edges traversing longitudinally and inward, connecting the narrow body to the bulbous tip; and the first width of the bulbous tip being narrower than the second width of each of the plurality of slots.

* * * * *